United States Patent [19]

Baldwin et al.

[11] 4,294,330

[45] Oct. 13, 1981

[54] MUFFLERS FOR PERCUSSIVE PNEUMATIC MACHINES

[75] Inventors: Stanley L. Baldwin, Winnipeg; Vernon Hampton, Thompson; Tony F. W. Embleton, Ottawa, all of Canada

[73] Assignee: Inco Limited, Toronto, Canada

[21] Appl. No.: 113,742

[22] Filed: Jan. 21, 1980

[30] Foreign Application Priority Data

Feb. 13, 1979 [CA] Canada ..... 321357

[51] Int. Cl.[3] ..... F01N 1/08; F01N 1/02

[52] U.S. Cl. ..... 181/230; 181/272; 181/273; 181/275

[58] Field of Search ..... 181/230, 266, 268, 272, 181/273, 275, 276, 250; 55/276; 173/DIG. 2; 415/119

[56] References Cited

U.S. PATENT DOCUMENTS

| | | | |
|---|---|---|---|
| 2,274,460 | 2/1942 | Raven | 181/273 |
| 2,857,414 | 10/1958 | Bourne | 181/273 |
| 3,181,647 | 5/1964 | Schomburg | 181/266 |
| 3,365,022 | 1/1971 | Jedd | 181/230 |
| 3,554,316 | 1/1968 | Barber et al. | 181/230 |
| 3,815,705 | 6/1974 | Bennett | 181/230 |
| 4,010,819 | 3/1977 | Ekström et al. | 181/230 |
| 4,079,809 | 3/1978 | Visnapuu et al. | 181/230 |
| 4,079,810 | 3/1978 | Prather et al. | 181/266 |

FOREIGN PATENT DOCUMENTS

| | | | |
|---|---|---|---|
| 1283616 | 11/1968 | Fed. Rep. of Germany | 181/268 |
| 329239 | 5/1930 | United Kingdom . | |
| 506209 | 5/1939 | United Kingdom . | |
| 515132 | 11/1939 | United Kingdom . | |
| 789784 | 1/1958 | United Kingdom . | |
| 999333 | 7/1965 | United Kingdom . | |
| 1035437 | 7/1966 | United Kingdom . | |
| 1494551 | 12/1977 | United Kingdom . | |

*Primary Examiner*—L. T. Hix
*Assistant Examiner*—Thomas H. Tareza
*Attorney, Agent, or Firm*—Raymond J. Kenny; Ewan C. MacQueen; Lewis Messulam

[57] ABSTRACT

A muffler for use with machines such as pneumatic drills consists of an elastomeric housing divided into an admission chamber and a series of muffler chambers. Within the housing are an inlet conduit communicating with the admission chamber and each muffler chamber, an exhaust conduit communicating with each muffler chamber as well as with a tail pipe outside the housing, and a Helmholtz resonator communicating with the admission chamber.

8 Claims, 8 Drawing Figures

Fig. 4.
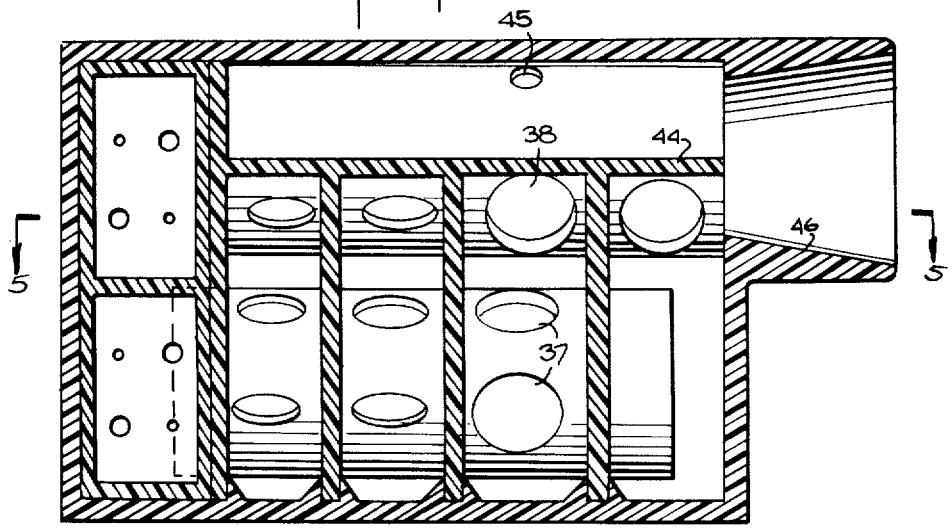
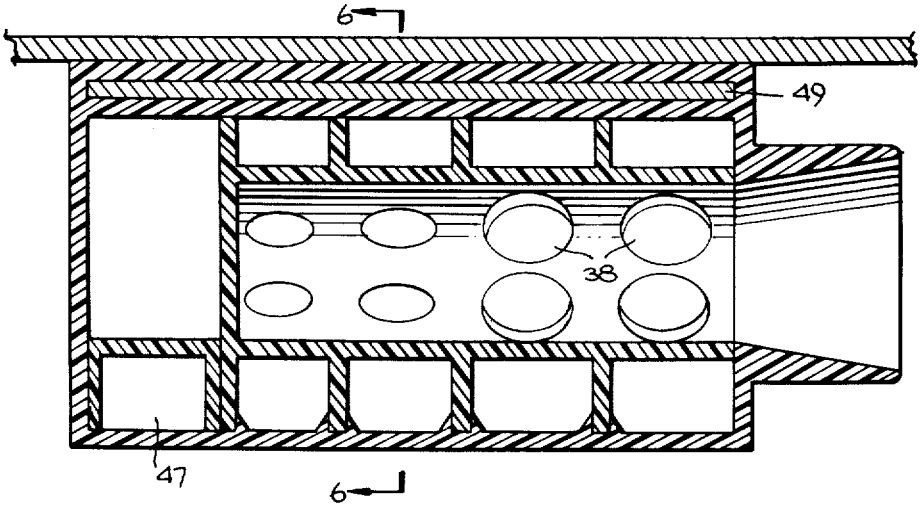
Fig. 5.

Fig. 7.
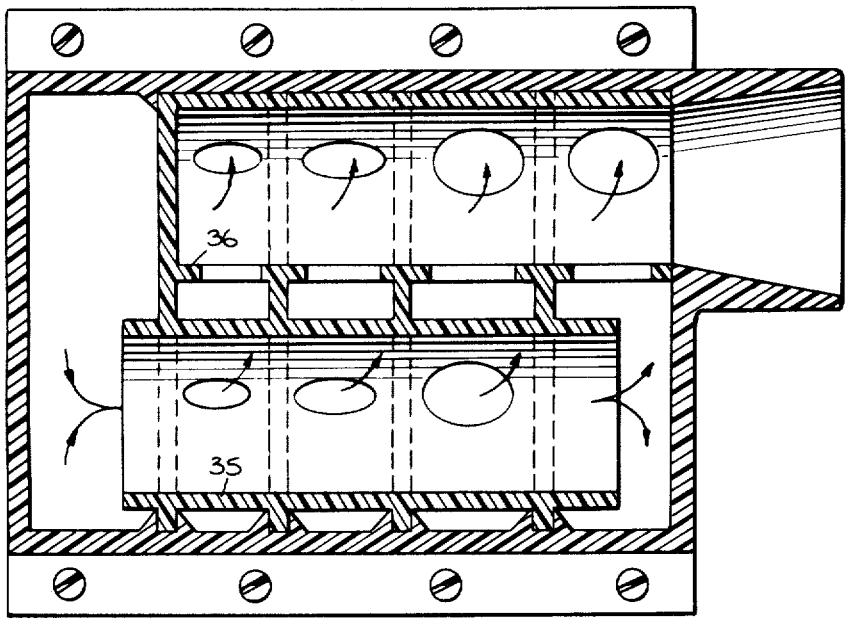
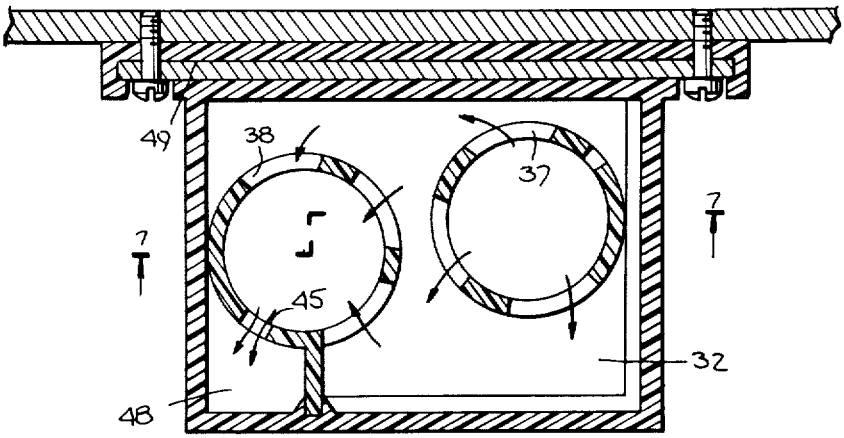
Fig. 6.

MUFFLERS FOR PERCUSSIVE PNEUMATIC MACHINES

The present invention is directed to a muffler for mounting on a pneumatic tool such as a drill of the type used underground which is designed to prevent freezing of the exhaust during operation of the machine and to atenuate the sound generation from the machine.

BACKGROUND OF THE INVENTION

Pneumatic machines having reciprocating air-powered motors have been used for rock drilling underground for many years. The machines are efficient, readily transportable, rugged in construction, and long-lived in operation. However, use of such machines underground has always been attended by a number of problems. Thus the operating air always contains some dissolved moisture with the resulting tendency for freezing of the exhaust ports in the machine. It has been reported that in efficient machines the temperature of the air can drop as much as 70° F. during passage through the machine. Freezing of the exhaust, of course, renders the machine incapable of further use when the exhaust ports become blocked with ice and the machine cannot be used again until the ice is cleared from the exhaust ports. The action of a miner in clearing the exhaust is all too often highly drastic in nature. Assaults on the machine with hammers, picks, drill steel, wrenches and the like are all to common when freezing of the exhaust occurs. Such assults can and frequently do result in breakage or permanent damage to the air cylinder. In addition, since the air operated drill is energetic, noise is generated, especially when operating underground, at a level sufficiently high to be physically damaging and/or painful. Governmental regulations now frequently require that each pneumatic drill be provided with a muffler which is usually welded or brazed directly on the body of the machine so as to cover the exhaust ports with the muffler being provided with exhaust holes at an end thereof. Such mufflers do offer some sound attenuation. However, the problem of exhaust freezing still remains and the extent of sound attenuation is insufficient. Steel mufflers of the aforedescribed type which are welded directly to the body of the air cylinder are roughly rectangular in shape with a flat outer face standing free of the air cylinder and with extending sides which are welded to the air cylinder so as to form a box enclosing the exhaust ports of the machine itself. It is desirable that freezing of the exhaust ports be prevented altogether and that further attenuation of sound level be achieved.

Many approaches to the foregoing problem have been suggested in the prior art. Thus U.S. Pat. Nos. 3,815,705, 3,554,316, 3,365,022, 4,010,819, 4,079,809, and U.K. Pat. No. 329,239 disclose devices intended to solve the problem. While the aforementioned devices have offered some improvement in performance, the resulting performance is still not acceptable from the operating viewpoint. Air operated feed-leg drills commonly used underground are called respectively a "stoper" and a "jackleg drill". As is known, the stoper is elevated from the ground by means of an air cylinder which is aligned with the drill body. The jackleg drill, on the other hand, has an air cylinder at an angle to the drill body and is fastened thereto by means of a swivel joint. The function of the elevating air cylinders is to press the drill steel against the bottom of the hole being drilled. It is also to be remembered that a conventional penumatic drill has a reciprocating air motor which is relatively small in size and the space in which a muffler can be mounted is limited by the dimensions of the air cylinder itself. Thus a muffler to be acceptable to an underground miner must not interfere with operation of the machine by the miner himself. Furthermore, due to the nature of drilling work underground, it is not practical to isolate the machine from the surrounding as can be done, for example, by building a soundproof room around a noisy device. Instead, the miners must work in close proximity to the drill while it is operating. These factors combined with the high level of sound intensity generated by the pneumatic drill in action makes the problem of providing a satisfactory muffler a difficult one indeed. The air cylinder reciprocates at a rate of approximately 2000–2400 cycles per minute generating an exhaust of high velocity air, and an exhaust noise having a wide range of sound frequencies.

SUMMARY OF THE INVENTION

The invention is directed to a muffler comprising a housing adapted to receive the discharge exhaust gas from said impact device and made of an elastic, high damping, hydrophobic material, a gas entrance chamber in said housing communicating with a Helmholtz resonator tuned to a frequency in the range of about 500 to 2,500 Hertz, a gas transport conduit exiting from said gas entrance chamber at an abrupt angle from the direction of gas entrance into said chamber, a plurality of first ports in the wall of said gas transport conduit, said first ports having a total cross-sectional area at least equal to the cross-sectional area of said gas transport conduit, a gas discharge conduit having a plurality of second ports in the walls thereof, a plurality of mutually isolated gas transport chambers each in communication with at least one of said first ports and at least one of said second ports, each of said gas transport chambers having a cross-sectional area substantially greater than the cross-sectional area of said first and second ports in communication therewith, the gas path in said transport chamber being at an abrupt angle from the direction of flow in both said gas transport conduit and in said gas discharge conduit.

The invention is also directed to a process for muffling the noise of a pulsating stream of gas discharging from an impact device operating at a frequency below about 60 Hertz comprising abruptly altering the direction and speed of said pulsating gas stream within an elastic, high damping housing to dissipate sonic energy by thus causing pulsation of said housing, dividing said gas stream into a plurality of substreams and altering the velocity of gas in each of said sub-streams and combining said plurality of said sub-streams into a single discharge gas path whereby additional sonic energy is dissipated by interference.

A preferred embodiment of the invention consists of a muffler of the reactive type made of a plastic or elastomeric material such as polyurethane generally in the configuration of a rectangular box mountable directly on the steel muffler which encloses the exhaust ports in the air cylinder of the drill itself and with the elastomeric muffler box being in communication with the chamber formed by the steel muffler. The pre-existing exhaust aperture of the steel muffler is sealed off so that exhaust gas is conducted into the elastomeric muffler which itself comprises an admission chamber, at least one resonator chamber and a series of muffler chambers through which the exhaust passes. Exhaust gas is admitted into the admission chamber having at least one resonator chamber forming at least part of a wall thereof and then through a plastic, e.g., polyurethane, inlet tube located toward one side of the muffler container with the tube having passages, e.g., holes, from the tube into a succession of muffler chambers. A second or exhaust tube mounted parallel to the aforementioned inlet tube and likewise having holes admitting air thereinto from each of the successive muffler chambers conducts the exhaust air to the atmosphere. The inlet tube may be closed at the end wall defining the end of the last of the series of muffler chambers. More preferably the inlet tube terminates at an open end which extends about one-half the distance between the last muffler chamber-defining partition and the end wall of the muffler housing. The exhaust tube is closed at its inner end so that exhaust gas can only be admitted thereinto by way of holes in the exhaust tube within the muffler chambers. The gas finally exits from a tail pipe which constitutes an extension of the exhaust tube beyond the housing of the muffler and preferably the inside of the tail pipe is frusto-conical in shape, expanding at an angle of $8° \pm 1°$.

A preferred feature of the invention comprises providing a second resonator chamber within the muffler housing. Such a second resonator can be made to communicate with either of the inlet and exhaust tubes or with the penultimate muffler chamber. In the most preferred embodiment the second resonator chamber comprises a half-wave resonator provided alongside the exhaust tube and in communication therewith via a single hole which is offset relative to the axial mid-point to that tube.

To aid in understanding of the invention a preferred embodiment as well as its method of construction will now be described in detail with reference to the accompanying drawings.

BRIEF DESCRIPTION OF THE DRAWINGS

FIG. 4 is a cross-sectional view of the muffler of the invention along the line 4—4 of FIG. 2;

FIG. 5 is a cross-sectional view of the muffler of the invention along the line 5—5 of FIG. 4;

FIG. 6 is a cross-sectional view of the muffler of the invention along the line 6—6 of FIG. 5; and FIG. 7 is a cross-sectional view of the muffler of the invention along the line 7—7 of FIG. 6.

DETAILED DESCRIPTION OF THE EMBODIMENT

Figures 1, 2:
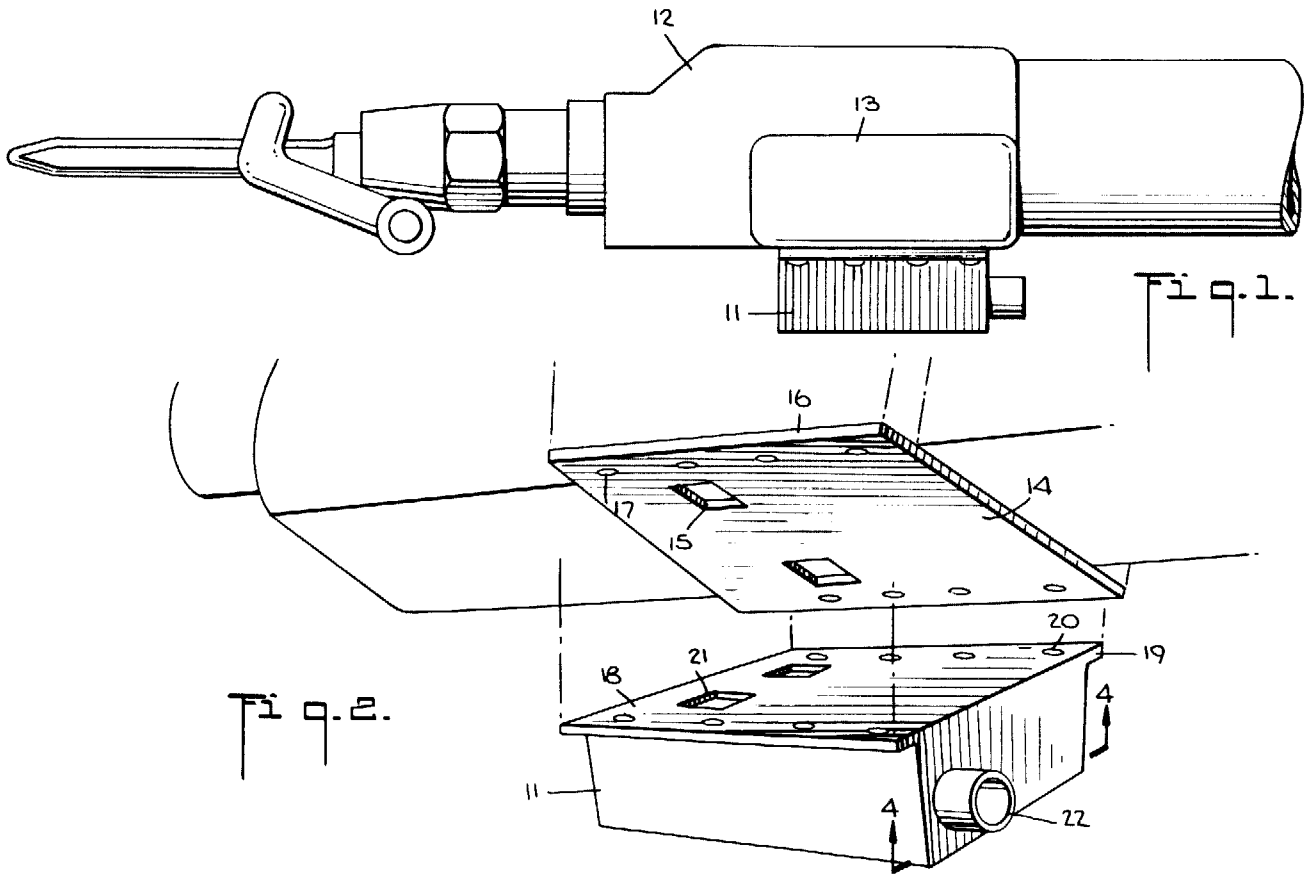
FIG. 1 depicts a conventional stoper drill provided with a steel muffler which has been modified by mounting a muffler in accordance with the invention directly upon the flat face of the steel muffler which is welded to the air cylinder of the drill.
FIG. 2 depicts the flat surface of the steel muffler welded to the air cylinder of the drill and illustrates the method of mounting of the muffler of the invention.

In FIGS. 1 and 2 a muffler 11 embodying the present invention is shown mounted on a drill 12 by bolting it onto a face of the steel muffler 13 originally fitted to the drill. In the embodiment illustrated the original steel muffler was modified to provide the desired method of mounting. The modification consisted of cutting off the original surface of the steel muffler which contained the gas exit apertures, and welding on in place thereof a flat plate 14 having apertures 15 which constitute the only means of egress of gas from the chamber of the original muffler 13. In order to minimize the risk of blockage of the apertures 15 by ice formed in operation the surfaces of these apertures were lined with plastic to provide elastomeric liners of a hydrophobic nature. The flat plate 14 is provided with lip portions 16 which carry bolt holes 17 for securing the elastomeric muffler. It must be appreciated that mounting the muffler had to be achieved in as limited a space as possible since excessive bult or weight of the muffler would be prohibitive under the operating conditions in a mine.

The elastomeric muffler 11 has a flat surface 18 which will be referred to as the base plate (while the opposed flat surface will be termed for convenience the roof of the muffler housing). The base plate 18 is provided with lip portions 19 having bolt holes 20 corresponding to the holes 17 in the steel plate 14. Apertures 21 are provided in the base plate 18 at positions which correspond with the apertures 15 in the steel plate 14 when the muffler has been installed. Thus in operation exhaust gas enters the chamber of the steel muffler from the air cylinder, passes via apertures 15 and 21 into the elastomeric muffler and exits finally from a tail pipe 22 of the elastomeric muffler.

Figure 3A:
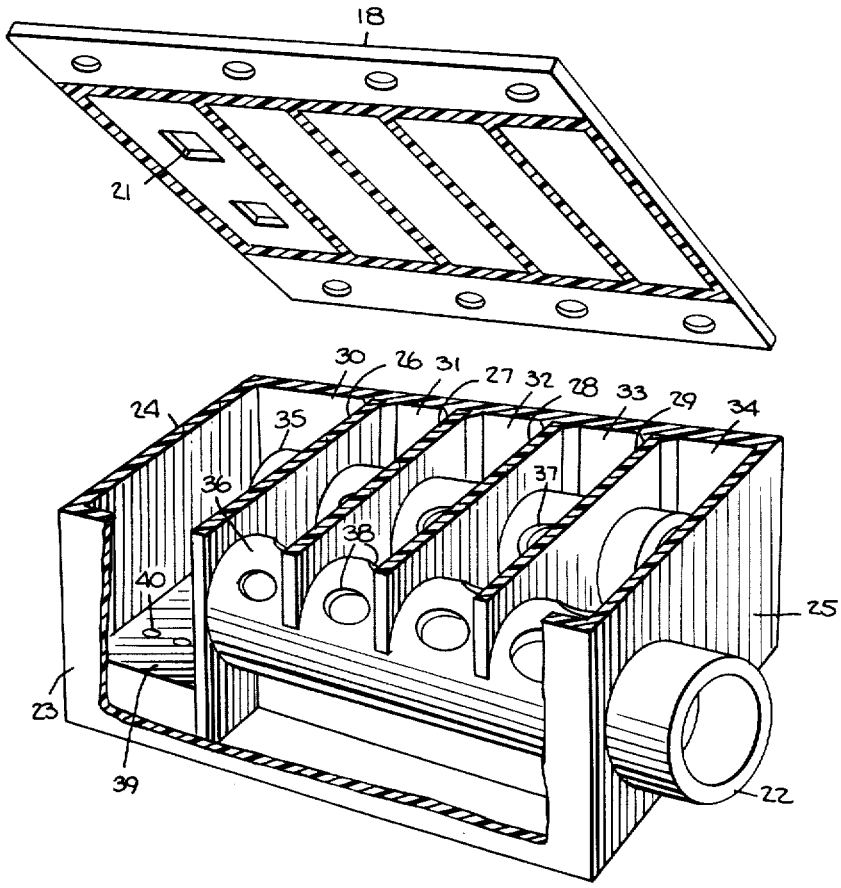
FIG. 3A is a perspective view of the muffler of the invention depicted in FIGS. 1 and 2 with the base plate and a portion of the housing wall cut away to expose the inner structure.
Figure 3B:
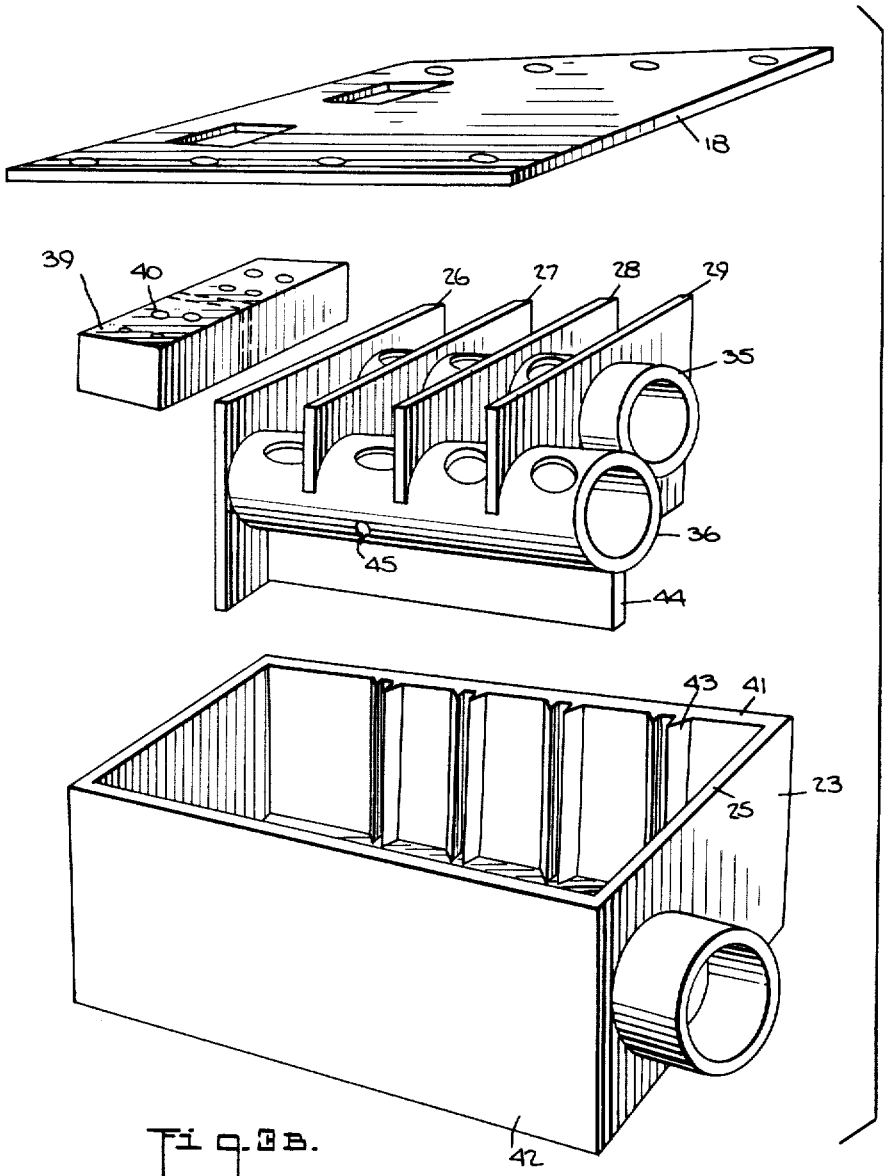
FIG. 3B is an exploded perspective view of the muffler shown in FIG. 3A.

FIGS. 3A and 3B depict the muffler of the invention opened up to show the interior construction thereof. In the view of FIG. 3A the base plate 18 has been removed from the remainder of the muffler housing 23 which is simply a rectangular elastomeric box. One of the side walls of the box has been cut away to show contents more clearly. It will be seen that disposed between the opposed end walls 24 and 25 are a series of elastomeric transverse partitions 26 through 29. These partitions serve to define an admission chamber 30 and four muffler chambers 31 through 34. A pair of elastomeric tubes 35 and 36 lie with their longitudinal axes parallel to one another and normal to the partitions. The first tube 35 is an inlet conduit which is open at both ends and penetrates through all of the partitions 26 through 29 to define a cylindrical passage extending from the admission chamber 30 to approximately the midpoint of the muffler chamber 34. The second tube 36 is an exhaust conduit open at one end which communicates with the tail pipe 22 through the end wall 25, while the closed end of the exhaust tube terminates at the partition 26.

Ports 37 and 38 are provided in the walls of the tubes 35 and 36 respectively within the chambers 31 through 34. Within each of the muffler chambers 31 through 33 at least one port 37 is provided for gas to pass from the tube 35 into the chamber in question; and at least one port 38 is provided for gas to pass from the chamber into the exhaust tube 36. In the case of muffler chamber 34 gas flows from the open end of inlet tube 35 into the chamber and therefrom into the exhaust tube via ports 38 in the latter. As will be seen more clearly by reference to the cross-sectional drawings of FIGS. 4, 5 and 7, the ports in each of the tubes 35 and 36 are not uniform. Rather, the area of the ports increases progressively from chamber 31 to chamber 34 to take account of gas pressures at various points along the tubes. However, an essential criterion is that the cross-sectional area of any chamber exceeds the total area of the ports in either tube in communication with that chamber. This ensures a decrease in gas velocity as it enters the chamber and a subsequent increase as it leaves it.

The admission chamber 30 does not extend to the roof of the housing but to a surface 39 having holes 40 therein. This surface 39, as will be seen from FIG. 3B, constitutes the face of a Helmholtz resonator. The latter comprises an open-faced rectangular box of elastomeric material mounted with its open face towards the roof of the housing so that a resonator chamber is defined with the holes 40 providing the only communication therewith. The resonator chamber is at least 1.2 cm deep between the housing roof and the resonator face 39, and the open area in the resonator face is between about 4 and 30%, preferably 15 to 20% of the area of face 39.

As shown in FIG. 3B, the housing 23 of the muffler is provided in the end walls 41 and 42 thereof with ribs 43 which engage the edges of the partitions 26 to 29 when the assembly of tubes and partitions is inserted into the housing. It will also be seen from this exploded diagram that although partitions 27 to 29 completely surround the inlet tube 35, they surround only partially the exhaust tube 36. Moreover, a longitudinal partition 44 is provided which extends from the surface of the exhaust tube to the roof of the housing and from the end wall 23 to the partition 26. As a result when the unit is assembled an elongate chamber is defined by the partition 44 and portions of the tube wall, the housing roof, side wall 42, end wall 23 and partition 26. This elongate chamber alongside the exhaust tube is sealed except for a hole 45 in the exhaust tube wall permitting communication therewith. The chamber, shown as 48 in FIG. 6, constitutes a half-wave resonator chamber within the muffler housing and resonates at a wavelength of about 19 cm. The first resonator chamber which had a resonant frequency in the range 500 to 2,500 Hertz is indicated by the reference numeral 47 in FIG. 5.

As will be seen from the cross-sectional view of FIG. 4 the tail pipe has an internal surface 46 which is frustroconical, expanding at about $8° \pm 1°$.

A further feature of the design of the muffler is the use of steel reinforcement to ensure the desired rigidity of the base plate 18. As will be seen from the views of FIGS. 5 and 6, the base plate includes a steel plate 49 which is provided with the appropriate boltholes embedded within the elastomeric material of the base plate.

The preferred embodiment described above was constructed in the following manner. Four moulds were prepared to produce the four components of the muffler shown separately in the exploded diagram of FIG. 3B, i.e., a housing, an assembly of tubes and partitions, a resonator box, and a base plate. The first mould used for producing the muffler housing was a rectangle 14.6 cm long, 10.2 cm wide and 7.3 cm deep. A matching core was designed to provide a gap of about 4.8 mm between mould and core.

The second mould and matching core therefor, used to produce the tubes and partitions, were dimensioned to produce tubes of between 2.0 and 2.4 mm wall thickness, and about 3.4 cm internal diameter. The finished tubes had holes therein, the total area of the holes being 27.0 and 26.7 $cm^2$ in the case of the inlet and exhaust tubes respectively. The partitions were spaced to provide unequal chambers, the spacing between the partitions varying from 2.0 to 2.7 cm.

The third mould and matching core therefor, were dimensioned to produce a resonator box which measured $9.2 \times 2.9 \times 1.9$ cm, the wall thickness thereof being about 2.0 mm. The fourth mould was a tray-like cavity 14.9 cm long, 12.7 cm wide and 1.0 cm deep, provided with bosses to form the gas inlet apertures in the base plate as well as plastic rivets and collars to space the steel reinforcing plate from the final base-plate surface.

The surfaces of the moulds and cores were covered with a silicone rubber to facilitate removal of the mouldings then prepared using a castable polyurethane mixture comprising a prepolymer manufactured by Uniroyal under the trade name Vibrathane B601, a 95% stoichiometric quantity of a curative manufactured by Anderson Development, Adrian, Mich., under the trade name Curene 243, a coloring agent and 0.1% (based on prepolymer weight) of a weak organic acid to act as catalyst. This castable mixture was produced by heating and degassing the prepolymer at 55°-65° C. and stirring in the other ingredients.

The castable mixture was poured into the first three of the above-mentioned moulds which were heated to 60° C. for 5 hours to effect a partial cure. The partially cured components were removed from the moulds and assembled together using the castable mixture as bonding agent. This sub-assembly was then heated to 60° C. for 1 to 2 hours until the components had just set and placed, open face-down, into the fourth mould to rest on the suspended steel plate which had been sandblasted and primed with a commercial urethane primer. A further quantity of the castable mixture was poured into the mould. Holes provided in the steel plate allowed the mixture to penetrate through it and thereby coat both faces of the plate and bond to the internal partitions. The mould was then heated for over 3 hours at 60° C. The finished product was then removed and cured at 100° C. for 3 hours and thereafter post-cured at 60° C. for 24 hours. It will be appreciated that the above conditions of time, temperature and composition are not critical and are given to disclose the best mode known to applicants. The conditions may be varied widely providing it is ensured that the sub-assemblies are not fully cured prior to the final assembly.

The assembled muffler was mounted for testing onto an air operated stoper drill. In order to retrofit the new muffler onto the pre-existing steel muffler, the outer face of the latter was cut away and replaced by a steel plate. The new plate which was 4.8 mm thick had a flat face measuring 12.7 cm by 14.0 cm, and inwardly bent legs which were welded to the sides of the old muffler to form a closed box therewith. Two air outlets holes were cut out of the flat face to match the inlet holes in the base plate of the elastomeric muffler. The outlet holes were made larger in total area than the air cylinder exhaust ports discharging into steel muffler. Moreover, they were disposed opposite to, but not in alignment with, the air cylinder exhaust ports. The latter had a total area of about 7 $cm^2$, while the holes cut in the plate had a total area of about 17 $cm^2$. A series of threaded boltholes were provided in the new steel plate for securing the muffler of the invention.

The particular stoper on which the muffler was fitted had an air cylinder of 7.9 cm diameter with a 6.7 cm stroke. Air was fed to the drill at a pressure of 586 Kilopascals through a hose of 3.2 cm internal diameter. At this pressure machine provided about 2,500 blows per minute and exhausted air at the rate of about 4,800 standard liters per minute.

The noise attenuation achieved by mufflers in accordance with the present invention is based upon sound absorbing and impedance mismatch principles which cause a reflection of part of the acoustical energy of the exhaust back to its source. Abrupt changes in cross sections available to the air flow within the muffler generate mismatched impedance with minimal increase in back pressure. The resonator action does not cause increase in back pressure but does absorb acoustical energy particularly in the important higher frequencies which, if not absorbed in the device, add significantly and cumulatively to overall noise pressure. The assembly was tested in an underground room having rock walls and ceiling and a concrete floor to determine noise level using a Bruel & Kjaer Type 2209 Precision Meter with a Type 1613 Octave Filter Set and a 2.5 cm microphone having a 3-meter extension and windscreen. Sound pressure level readings were taken under two test conditions, namely, test condition No. 1 "running, not drilling" and test condition No. 2 "drilling with a standard steel drill".

For the purpose of comparison, noise measurements were also made using a drill which had not been fitted with the muffler of the invention, i.e., having only a steel muffler. Apart from the presence of the elastomeric muffler of the invention, the drills as well as the set-up for noise testing were identical. In each case noise measurements were made with the drill running at full throttle with no drill steel attached for the condition No. 1 tests, and with a standard steel drill drilling into the roof for the condition No. 2 tests. The microphone which had an omnidirectional pick-up head was positioned 0.6 meters away from the drill along a line perpendicular to the drill axis. Using the octave band filter, sound level (SL) readings were taken at ten frequency bands having center frequencies from 31.5 to 16,000 Hertz. In the tables below the individual SPL readings in decibels (dB) are shown for both the drill muffled in accordance with the invention and the comparative drill.

Table 1 shows the data obtained under condition 1 (free running) while Table 2 shows the condition 2 results. In each case the table also shows the corresponding "A weighted sound level". These weighted values generally referred to as dBA, are calculated according to an internationally adopted scale whereby the noise at various frequencies is weighted in such a way as to simulate the response of the human ear. The dBA values are criteria used in sound legislation specifying permissible durations of exposure to given sound levels.

TABLE 1

(Test Condition No. 1)

| Center Frequency Of Octave Band (Hertz) | Sound Pressure Levels (dB) Unmodified Drill | With Muffler Of The Invention |
|---|---|---|
| 31.5 | 84 | 91 |
| 63 | 98 | 98 |
| 125 | 104 | 102 |
| 250 | 104 | 108 |
| 500 | 106 | 102 |
| 1k | 111 | 103 |
| 2k | 106 | 100 |
| 4k | 104 | 97 |
| 8k | 106 | 96 |
| 16k | 98 | 89 |
| "A Weighted Sound Level" | 114 | 107 |

TABLE 2

(Test Condition No. 2)

| Center Frequency Of Octave Band (Hertz) | Sound Pressure Levels (dB) Unmodified Drill | With Muffler Of The Invention |
|---|---|---|
| 31.5 | 79 | 83 |
| 63 | 100 | 105 |
| 125 | 101 | 104 |
| 250 | 103 | 100 |
| 500 | 104 | 103 |
| 1k | 109 | 105 |
| 2k | 107 | 105 |
| 4k | 107 | 105 |
| 8k | 107 | 102 |
| 16k | 99 | 95 |
| "A Weighted Sound Level" | 114 | 111 |

The data given in the tables shows that although the frequency of operation of the air cylinder is below 60 Hertz, the exhaust generates a complex sound spectrum which is measurable over a range of frequencies up to and including 16,000 Hertz. As is known, the machine itself operates by impelling a piston to strike a striker bar which holds the drill steel rod, the other end of which digs into the rock being drilled. Means are provided in the drill to reciprocate the piston and rotate the drill bit. The mechanical actions within the drill also contribute to the noise generated.

The results of the tests show that significant sound attenuation is achieved by fitting a muffler in accordance with the invention to the machine. The benefits are particularly significant in terms of the attenuation achieved at the more critical frequencies to which the human ear is most responsive. This is reflected by the dramatic lowering, under both test conditions, of the "A weighted sound level" by 3 dBA in one case and 6 dBA in the other. Sound levels of the order of those achieved with the muffler of the invention are capable of yielding a sound level at the operator's ear of the order of 85 dBA when ear protection is used.

Experiments with the converted drill in underground mining have indicated that the new muffler is virtually indestructable when subjected to impact and abrasion of the character to which the drill itself is normally subjected in use. The freedom from icing obviates violent assault upon the drill to clear exhaust ports and thereby avoids operator-caused mechanical damage to the drill.

The experiments also showed that the efficiency of the drill was not adversely affected by, and may have benefited from, the installation of the new muffler. Thus measurement of the drilling speed of the converted drill showed that it was apparently higher than that of an unconverted drill. Moreover, experience with the muffler suggests that it appears to lessen the vibrations of the machine and is immune to icing.

It will be understood that the invention has been described with reference to a preferred embodiment thereof mounted on a stoper drill. The invention is applicable to mufflers for other drills and more generally other pneumatic percussion devices. Moreover, various additions or modifications may be made to the details of the embodiment described without departing from the scope of the invention which is defined by the appended claims.

We claim:

1. A muffler for a pneumatic impact device operating at a frequency below about 60 Hertz comprising a housing adapted to receive and discharge exhaust gas from said impact device and made of an elastic, high damping, hydrophobic material, a gas entrance chamber in said housing communicating with a Helmholtz resonator tuned to a frequency in the range of about 500 to 2,500 Hertz, a gas transport conduit exiting from said gas entrance chamber at an abrupt angle from the direction of gas entrance into said chamber, a plurality of first ports in the walls of said gas transport conduit, said first ports having a total cross-sectional area at least equal to the cross-sectional area of said gas transport conduit, a gas discharge conduit closed at its inner end and having a plurality of second ports in the walls thereof, a plurality of mutually isolated gas transport chambers each in communication with at least one of said first ports and at least one of said second ports, each of said gas transport chambers having a cross-sectional area substantially greater than the cross-sectional area of said first and second ports in communication therewith, the gas path in said transport chamber being at an abrupt angle from both the direction of flow in said gas transport conduit and in said gas discharge conduit.

2. A muffler in accordance with claim 1 wherein a surface of said Helmholtz resonator constitutes a wall of said gas entrance chamber having a plurality of apertures therein.

3. A muffler in accordance with claim 2 wherein said Helmholtz resonator has a depth of at least 1.2 cm and an open area of about 4 to 30% of the face thereof.

4. A muffler in accordance with claim 3 wherein a closed chamber is provided alongside said gas discharge conduit, and a single aperture is provided in a wall of said gas discharge conduit to enable communication between said gas discharge conduit and said closed chamber, whereby said closed chamber operates as a half-wave resonator.

5. A muffler in accordance with claim 1 wherein said gas discharge conduit extends to an outer expansion tail pipe on the exterior of said housing having an inner frustroconical shape expanding at an angle of $8° \pm 1°$.

6. A process for muffling the noise of pulsating stream of gas discharging from an impact device operating at a frequency below about 60 Hertz comprising abruptly altering the direction and speed of said pulsating gas stream with an elastic, high damping housing to dissipate sonic energy by thus causing pulsation of said housing, dividing said gas stream into a plurality of sub-streams and altering the velocity of gas in each of said sub-streams and combining said plurality of sub-streams into a single discharge gas path whereby additional sonic energy is dissipated by interference.

7. A muffler in accordance with claim 1 wherein said gas transport chambers have greater volume toward the exit end of said muffler.

8. A muffler in accordance with claim 1 wherein said first gas transport conduit has an open exit end terminating midway of the gas transport chamber at the exit end of said muffler.

* * * * *